United States Patent [19]

Specht et al.

[11] 4,222,831

[45] Sep. 16, 1980

[54] INTERNAL GAS SEPARATION ASSEMBLY FOR HIGH CURRENT DENSITY ELECTROLYTIC CELLS

[75] Inventors: Steven J. Specht, Mentor, Ohio; Kenneth E. Woodard, Jr., Cleveland, Tenn.

[73] Assignee: Olin Corporation, New Haven, Conn.

[21] Appl. No.: 2,483

[22] Filed: Jan. 11, 1979

[51] Int. Cl.[3] ..... C25B 1/34; C25B 9/00

[52] U.S. Cl. ..... 204/98; 204/128; 204/278

[58] Field of Search ..... 204/258, 266, 278, 98, 204/128

[56] References Cited

U.S. PATENT DOCUMENTS

| | | | |
|---|---|---|---|
| 3,855,091 | 12/1974 | Piester | 204/128 |
| 3,928,165 | 12/1975 | Piester | 204/266 |

*Primary Examiner*—R. L. Andrews

*Attorney, Agent, or Firm*—Bruce E. Burdick; Thomas P. O'Day

[57] ABSTRACT

A gas separation assembly for an electrolytic cell having a gas-evolving electrode and a total cell current density above 2500 amperes per square feet of internal horizontal cell area is disclosed. The assembly includes a gas collector within the gas-evolving electrode and a disengager with less than 0.13 square feet of internal, horizontal, cross-sectional disengaging area per kiloampere of total cell current.

11 Claims, 9 Drawing Figures

INTERNAL GAS SEPARATION ASSEMBLY FOR HIGH CURRENT DENSITY ELECTROLYTIC CELLS

This invention relates to high current density electrolytic cells for the electrolysis of liquids and particularly to such cells with gas-evolving electrodes, and more particularly to gas disengagement means for such cells.

Previously, electrolysis of brine to yield chlorine has taken place in electrolytic cells having graphite anodes and operating at low current densities. In such cells of the prior art, erosion of the graphite anodes necessitated an anode having an initial thickness of 1 inch or more, thereby dictating an electrode pitch (center line-to-center line distance between electrodes of like polarity) of 3½ or even 4 inches. Diaphragm electrolytic cells of the prior art, operating at low current densities with thick electrodes at large pitches, had low ratios of current per cubic foot of cell volume, frequently as low as one-half or even one-fourth kiloampere per cubic foot of cell volume.

Newer electrolytic cells use metallic anodes. Such anodes are on a narrower pitch and may be operated at higher current densities. Typically, in order to take advantage of the apparent economies of such diaphragm electrolytic cells, electrolysis should take place at high anode current densities, for example above about 80 amperes per square foot of anodic surface, and preferably above about 100 amperes per square foot of anodic surface. Additionally, the electrodes themselves should be tall, typically 3 feet or more tall, and preferably 4 or more feet tall.

During electrolysis at high current densities (for example, at current densities of about 100 amperes per squre foot of anode surface) with tall electrodes (for example, above about 4 feet tall) and narrow interelectrode gaps (for example, with spaces of from about one-eighth to one-fourth inch between an anode and the diaphragm of the next adjacent cathode), several problems develop. Large volumes of gas are generated per unit of cell volume, resulting in frothing of the anolyte. The large fraction of gas in the anolyte causes the anolyte IR drop to increase. The concentration of chloride ion in the anolyte becomes non-uniform. According to this invention, the effect of such problems of electrolyzer operation may be diminished.

In the design and operation of higher current density chlorine alkali cells with anodes of two feet height, or greater, the disengagement of the chlorine is a problem. One solution to the problem is outlined in Piester U.S. Pat. Nos. 3,855,091 and 3,928,165 issued to PPG Industries, Inc., as assignee. In this method, a separation chamber is placed on top of the cell. Chlorine containing foam is conducted by a pipe from the top of the cell into the separation chamber, above the liquid level. Separation of the gas from liquid is promoted by changing direction of the stream at the outlet of the conducting pipe. Separated liquid is returned to the cell through a bottom connection from the separator.

The above patents disclose some specific quantitative information:

1. The claims pertain to cells having "currents above 2500 amperes per square foot of horizontal area" (i.e., 0.40 $ft^2$/kiloampere).

2. The chlorine riser has a cross-sectional area of less than 0.05 square feet per cubic foot of cell volume and less than 0.10 square feet per kiloampere of cell current.

3. The separation chamber has a horizontal cross-section area in excess of 0.06 square feet per cubic foot of cell volume and in excess of 0.10 square feet per kiloampere of cell current.

Another alternative is that of U.S. Pat. No. 4,064,021 (deNora and deNora) issued Dec. 20, 1977 to assignee, Diamond Shamrock Technologies, S.A. of Switzerland. This method teaches perforated multiple tubular anodes each with an imperforate upper portion which serves the same function as the conducting pipe in extending upwardly out of the electrolyte into a large disengaging space ("chlorine release space") where the direction of the stream is changed. This space requires a much larger cell than otherwise. These patents show that such large disengagers are considered necessary for high current density cells even by those of high skill in the art.

The rapid change in direction is thought to cause the disengagement in the Piester and deNora patents because of the difference in density of the gas and liquid phases. It is believed that the liquid falls quickly while the gas drops slowly after upward ejection from such conducting pipes thus separating the gas from the liquid.

There is thus a need for a cell design which does not require such costly space consuming disengagers and yet which can satisfactorily disengage the gas evolved from a gas evolving electrode. There is particular need for such a cell design in the chlor-alkali industry where costly high current density cell designs are being used in large number.

These and other problems are solved by the present invention which provides a gas separation assembly for an electrolytic cell having a cell body containing a liquid electrolyte and a gas evolving electrode in said liquid electrolyte and a total cell current density above 2500 amperes per square foot of internal horizontal cell area, which system comprises:

(a) gas collector means within said gas evolving electrode for collecting gas evolved therefrom and for partially separating said evolved gas from said liquid electrolyte, and (b) disengager means, having less than 0.13 square feet of internal horizontal, cross-sectional disengaging area per kiloampere of total cell current, for receiving said partially separated, collected, evolved gas from said gas collector means and fully separating said gas.

The invention will be better understood by referring to the attached drawing which depicts as a preferred example and embodiment the best mode currently envisioned for using the invention.

A significant part of the invention was the nonobvious study which led up to the solution of the problem. It has been found that 0.13 square feet of horizontal disengaging surface per kiloampere of total cell current is a fairly sharp critical point as regards the generation of foam in electrolytic cells, as indicated in U.S. Pat. Nos. 3,855,091 and 3,928,165. It is desirable to accomplish gas separation within the cell and it is also desirable to achieve such separation with a considerably lower factor than 0.13 square feet per kiloampere (KA). Gas separation is currently a "bottle-neck" in cell design. Current density, temperature of operation and electrode height all are limited because of gas separation difficulties. Various observations have been made of foam formation and of foam breaking and it has been found that foam formation is promoted by the flashing of water vapor as the gas bubbles rise from the depths of the liquid, such as for example anolyte, to the lower pressure at the surface. The depth of foam has been found to increase proportionally to the increase of current. Two distinct layers of foam have been observed, the upper layer being of higher gas content. Cell designs were first based on the concept that gas removal from the electrode would be most efficient when upward flow of anolyte was approximately equal to the rate of gas bubble rise; i.e., when there was little movement of the gas bubbles relative to the liquid. Later it was shown that with external recirculation completely shut off, the gas fraction in the upper portion of the anode chamber was essentially the same as with full recirculation, and that the foam level in the top of the cell was considerably reduced as compared to full recirculation. With lower anolyte flow rates, gas bubbles became larger and the larger bubbles had higher velocity rising through the anolyte. With low or 0 rate of anolyte recirculation, it was observed that sudden reversals of anolyte flow would occur locally in intervals of 30–60 seconds. Apparently, this occurred as a result of a build-up of bubbles in suspension, of a sudden release and of the backflow from the anolyte at the top of the cell to replace the volume of displaced bubbles. The pressure change in the anolyte to cause such flows is believed to be in the order of 5–5 inches of water. There was no recognized effect of these pressure surges, however, it is expected that gas release from the anode and deterioration of the diaphragm or membrane could result.

Figure 3:
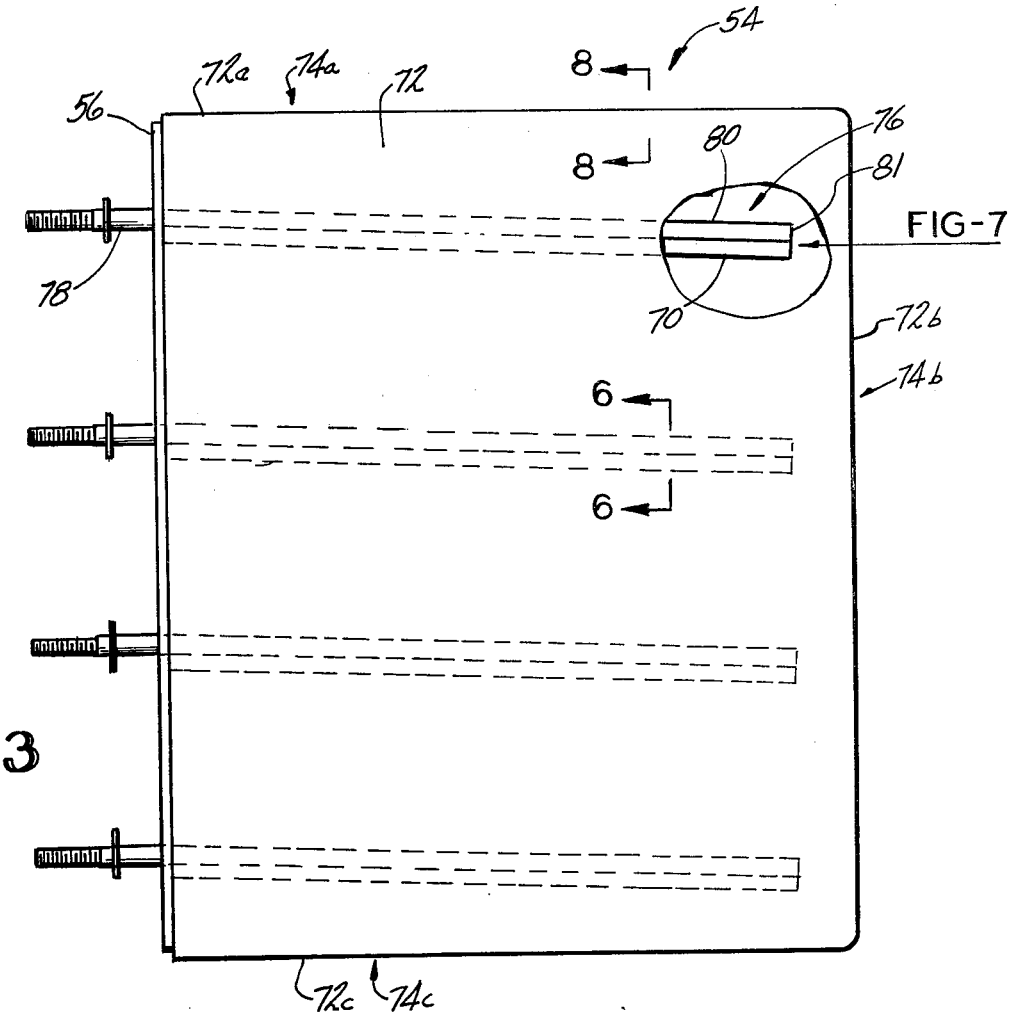
FIG. 3 is a front elevational view of the anode of FIG. 2 by itself.
Figure 4:
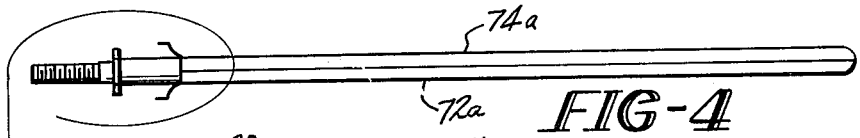
FIG. 4 is a top plan view of the anode of FIGS. 2 and 3.

Horizontal rods in the anode and an anolyte recycle of suitable linear velocity into the bottom of the anode appear to result in good performance, both in respect to cell efficiency and to minimum foam formation. A sloping anode rod with gas collector was expected to considerably reduce foam formation. Such a sloping rod and gas collector are seen in FIGS. 3 and 4 of U.S. Pat. No. 3,963,596, issued June 15, 1976 to Olin Corporation and naming Morton S. Kircher as inventor. Gas was collected under each rod and allowed to rise only in the confined space at the end of the anodes. Gas evolution in the confined space created a turbulent gas lift, but gas separation still corresponded to a critical ratio of 0.13 square feet of horizontal disengaging surface per KA for foam formation. Thus, it appeared that the use of sloping anode rods improved gas separation, but further improvement was desired. This led to the concept of a number of separation zones in the height of the anode with a gas duct leading from each zone into the gas collecting space. This would increase the horizontal disengaging surface area in proportion to a number of such zones provided. The use of such gas ducts and the problem of controlling pressures to avoid pumping liquid with the gas were believed to be too complicated a solution, just as the tubular anodes of the chlor-alkali diaphragm cell of U.S. Pat. No. 4,064,021, above noted, were believed to be too complicated. However, accumulating gas and allowing it to rise in large bubbles was believed to be nearly as effective, and much simpler. Therefore, it was proposed to use gas collectors under the anode rods, as in the design of FIGS. 3 and 4 of U.S. Pat. No. 3,963,596, above noted, but with the differences that the rods would be horizontal, the collectors under the rods would preferably be an inverted U-shape closed at each end so as to allow the accumulation of gas to a depth of, for example, approximately 1 inch and the end of the collectors extending into the gas escape space would be cut at a height of, for example, about ⅛ inch above the level of the bottom edges of the collectors in order to promote gas escape in large bubbles at this point.

As an alternative to the horizontal design with closing ends, it was also considered desirable to use sloped gas collectors with the end adjacent the gas escape space being approximately ⅛ inch above the level of the opposite end thereof. In this way, it was believed that promotion of gas escape in large bubbles would be achieved. Upon testing, it was found that this sloped collector design was, in fact, the preferred alternative and hence that is the embodiment described in detail below and depicted in the Figures. However, it is to be understood that the invention also includes within its scope the horizontal, closed-end collectors above-mentioned.

Figure 1:
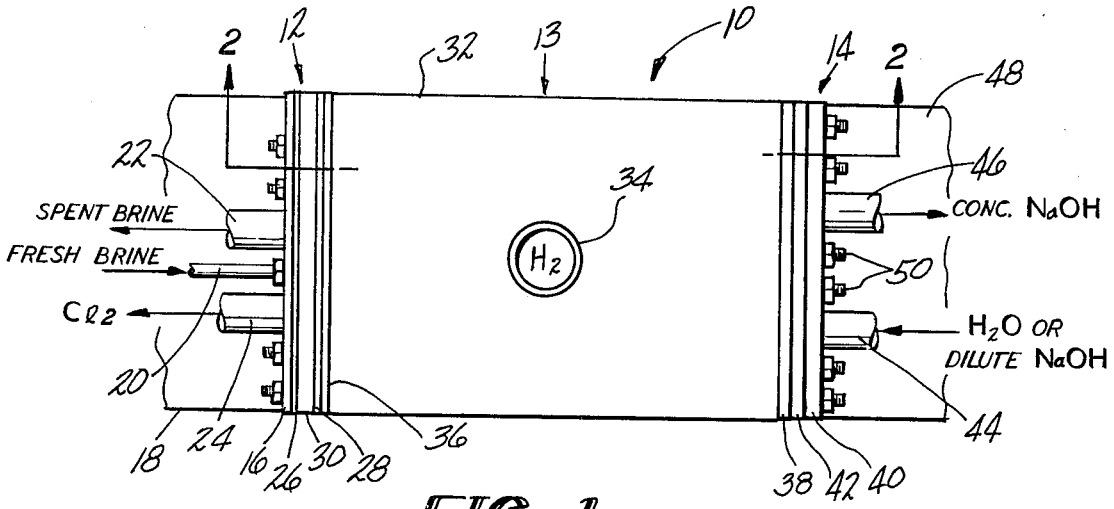
FIG. 1 is a top plan view of a chlor-alkali electrolyte cell showing fluid and electrical connections.

FIG. 1 is a top plan view of a chlor-alkali electrolytic cell 10 which can be any suitable type, such as for example that of U.S. Pat. Nos. 3,247,090 or 3,447,938. Cell 10 comprises an anode assembly 12, a central housing 13 and a cathode assembly 14. Anode assembly 12 comprises an anode backplate 16, an electrical conductor bus 18, a fresh brine inlet 20, a spent brine outlet 22, a chlorine outlet 24, a first seal 26, a second seal 28, a disengager 30 and a plurality of anode fingers to be described below in more detail. A suitable clamp (not shown) is used to hold backplate 16, seal 26, disengager 30 and seal 28 tightly against housing 13 so as to prevent leakage.

Backplate 16 is a rectangular plate, but could be a disc or other conventional shape. Housing 13 is a rectangular box 32 conforming to backplate 16 and is provided with a hydrogen outlet 34, a first flange 36 and a second flange 38. First flange 36 serves to enable clamping of backplate 16 and disengager 30 to housing 13. Flange 38 serves to enable clamping of a cathode assembly 14 similar to anode assembly 12 except without a disengager or second seal. Cathode assembly 14 includes a rectangular cathode backplate 40, a seal 42, a catholyte inlet 44, a catholyte outlet 46, a cathode conductor bus 48 and a plurality of cathode fingers (not shown) conductively attached to and cantilevered from backplate 40 by conductor rods 50.

Figure 2:
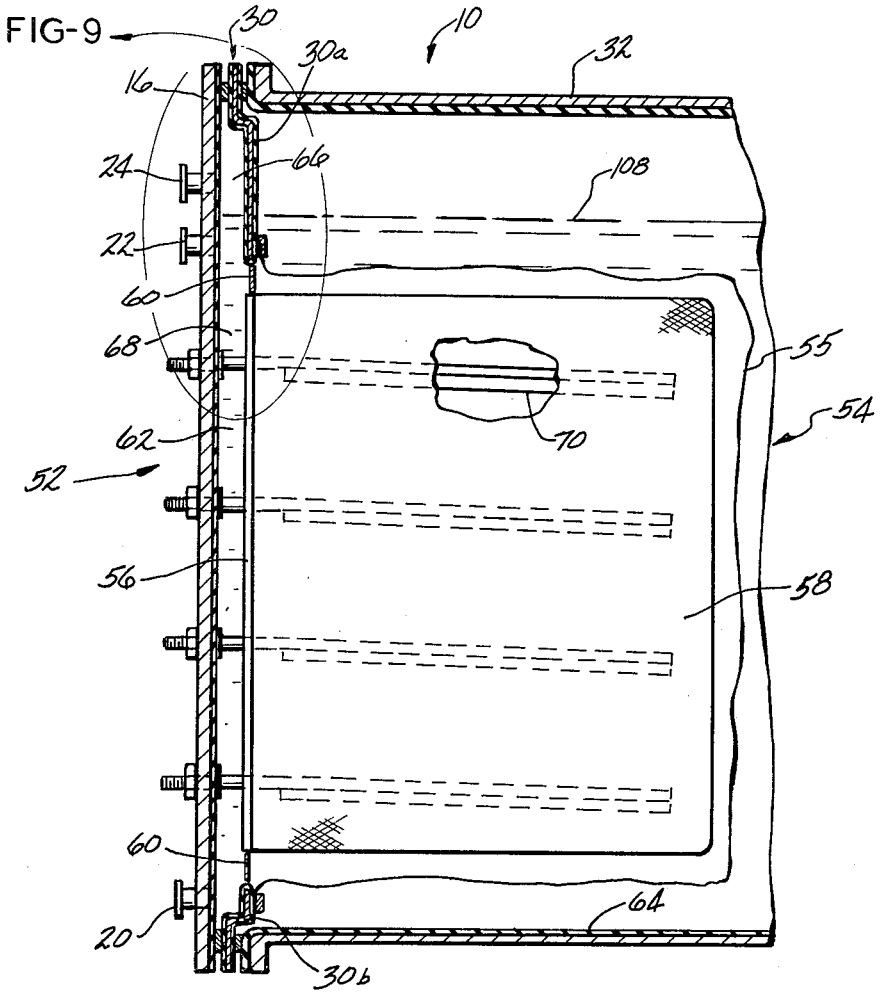
FIG. 2 is a cross-section through the cell of FIG. 1 taken along line 2—2.

Disengager 30 of FIGS. 1 and 2 can occupy less than 50% of the horizontal cell area and preferably less than 25 precent or even 10 percent or less.

FIG. 2 is a cross-section through cell 10 taken along lines 2—2 of FIG. 1 so as to show a gas separation assembly 52 of cell 10. Assembly 52 comprises backplate 16, disengager 30 and anode fingers 54 and is better seen in FIG. 9, as described below. Anode fingers 54 are of sloped-rod structure similar to that shown in FIGS. 3 and 4 of U.S. Pat. No. 3,963,596, above noted, commonly assigned which is incorporated by reference as if set forth at length herein. However, as will be apparent from reading U.S. Pat. No. 3,963,596, it was not thought that such sloped rods would enable a vastly reduced size disengager. However, upon actual prototype construction, such was surprisingly found to be possible. As noted above, initial tests indicated that the critical ratio in square feet of horizontal disengaging surface area per kiloampere of total cell current (hereafter "CR") is 0.13. However, actual cells surprisingly had a CR beneath 0.01 thus reducing the required disengager size by over 90 percent. Anode fingers 54 are best seen in FIGS. 3–8 described below. Anode fingers 54 have a rear spacer portion 56 and a body portion 58 which together with backplate 16, disengager 30 and a perforated clamp base 60 define a chlorine escape space 62.

The base 60 and disengager 30 preferably extend fully around the collective perimeter of the entire set of anode fingers 54, which fingers are positioned with their respective spacer portions 56 in abutment. A rubber lining 64 or other electrolyte-resistant lining can be provided to cover the exposed interior surfaces of housing 13, disengager 30 and backplates 16 and 40 (see FIG. 1) so as to minimize corrosion by brine, caustic or chlorine and give increased life to the cell parts.

Backplate 16 is provided with fresh brine inlet 20, spent brine outlet 22 and chlorine gas outlet 24 which connect space 62 to, respectively, a fresh brine supply, a spent brine reservoir and a chlorine gas line. Inlet 20 is preferably at or near the bottom of backplate 16 while outlets 22 and 24 are adjacent the top of backplate 16. Outlets 22 and 24 connect to the disengaging space 66, which is the portion of gas escape space 62 between disengager 30 and backplate 16. Anolyte 68 fills anode fingers 54 and space 62 to a level maintained above the bottom of outlet 22 and below the top of outlet 24. Any chlorine discharge line connected to outlet 24 could rise above outlet 24 so that brine does not flow out of outlet 24. Similarly, any spent brine drain line would drop below outlet 22 so that chlorine gas does not flow out of outlet 22. If foam generation occurs, it will be appreciated that either one or both of outlets 22 and 24 might receive such foam and this is not desired. Therefore, the cell design is such as to minimize foam generation and keep foam generation at a satisfactory level. This is achieved by combining sloped gas collectors 70 with disengager 30, gas collectors 70 serving to change the direction of flow of the gas bubbles, which change of direction produces a substantial amount of gas disengagement within collectors 70, i.e. within fingers 54.

FIGS. 3–7 show anode finger 54 in greater detail and without other associated cell parts, so that the structure thereof can be better understood. Collectors 70 are seen lying within fingers 54. Fingers 54 are in turn hollow planar mesh electrodes, such as for example of louvered titanium mesh coated with a titanium oxide-ruthenium oxide catalytic coating. Other conventional dimensionally stable anodes could also be used.

Generally seen, anode finger 54 is a vertical, planar, hollow electrode which comprises two planar foraminous working surfaces 72 and 74, a plurality of horizontally oriented conductor rods 76, a plurality of generally horizontal gas collectors 70 and a pair of vertical spacer portions 56. Surfaces 72 and 74 can be any conventional anode working surfaces, such as for example a titanium mesh with a catalytic coating of a titanium oxide and ruthenium oxide. Surface 72 and surface 74 are oriented generally parallel to each other and spaced apart by the thickness of rods 76 and collectors 70. If desired, the structure of anode finger 54 could be made expandable by use of the gas collector as a spring to outwardly bias the working surfaces 72 and 74 relative to each other. Working surfaces 72 and 74 can be welded together along their top edge **72*a* and 74*a*, respectively such as by a conventional butt welding process and can similarly be welded along their outer edge 72*b* and 74*b* and bottom edge 72*c* and 74*c*, respectively. The purpose of this welding is to prevent sharp edges which might tear any surrounding diaphragm or membrane and such welding would be one method of closing anode finger 54 if an adherent diaphragm or membrane was placed thereon. In the conventional diaphragm cell, the diaphragm is applied to the cathode rather than the anode, however, in some membrane cell designs, the anode is enclosed rather than the cathode. The anode is enclosed in the preferred cell 10. It will be understood that the descriptions given above and below with respect to anode finger 54 would apply equally to corresponding cathode fingers (not shown) which could have horizontal conductor rods and gas collectors similar to rods 76 and collectors 70**.

Figure 9:
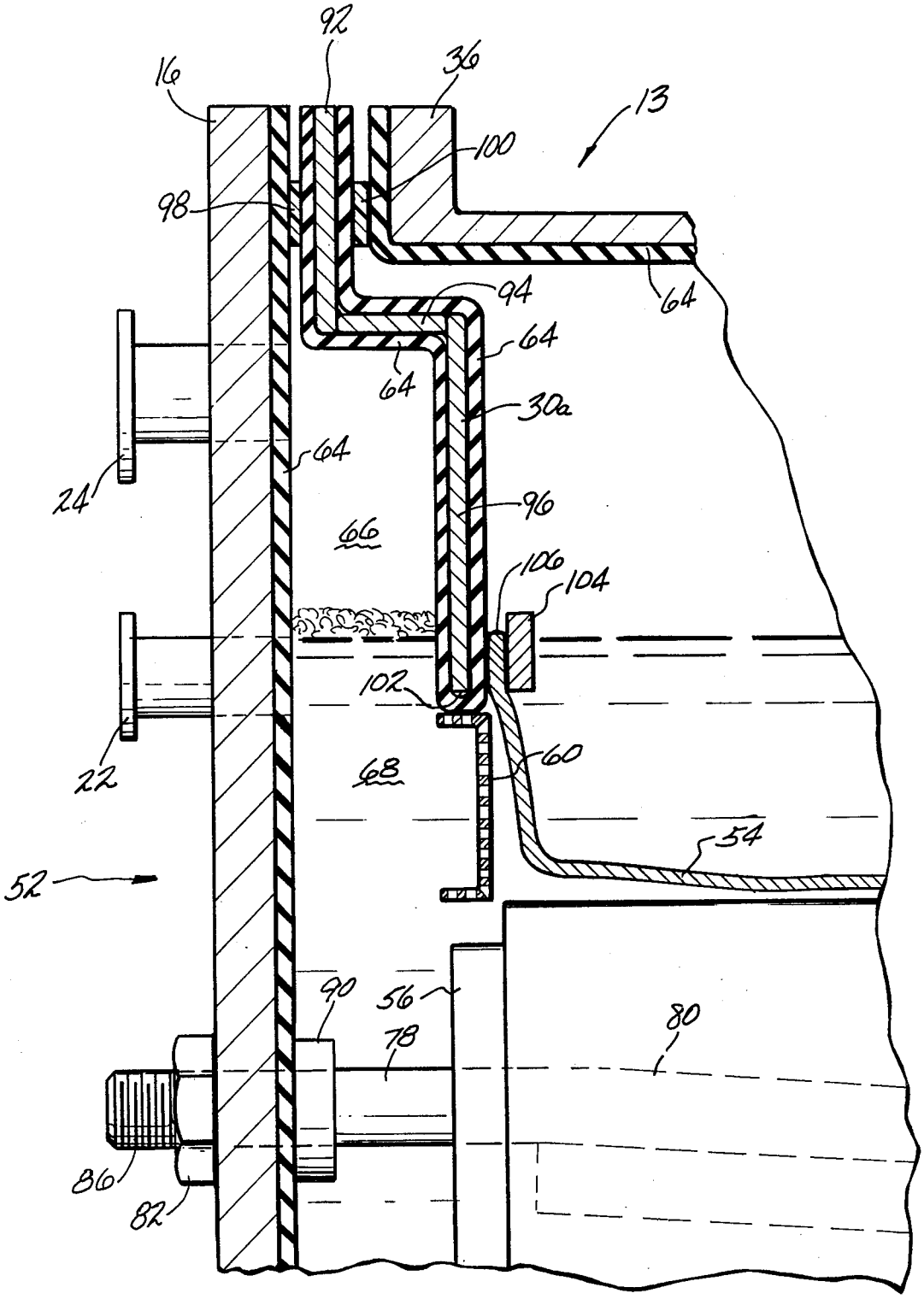
FIG. 9 is an enlarged view of the disengaging space of the cell of FIG. 2 showing portion 9 of FIG. 2.

Rod 76 comprises a threaded connector portion 78 and a mesh attachment portion 80. Connector portion 78 is threaded so as to receive a nut 82 after passing through anode backplate 16 so as to mount anode finger 54 on anode backplate 16 in a vertical position aligned with other similar anode fingers 54. The attachment of connector portion 78 to anode backplate 16 is best seen in FIG. 9, described below. Mesh attachment portion 80 is sloped downwardly from connector portion 78 to an outer tip 81 of rod 76. Attachment portion 80 is generally aligned with gas collector 70 so that gas collector 70 is sloped the same as portion 80. Portion 80 is attached to surfaces 72 and 74 by support welding or other suitable connection so that current may be supplied to surfaces 72 and 74 by portion 80. Alternately, gas collector 70 could be placed between rods 76 and surfaces 72 and 74 and be ourwardly biased so as to make finger 54 expandable, as above noted. In such a case, collectors 70 would be welded or otherwise attached to surfaces 72 and 74. One preferred structure for collectors 70 and rods 76 is that of FIGS. 3 and 6 in which a round rod 76 is placed between surfaces 72 and 74 and support welded at selected locations to surfaces 72 and 74. In this preferred structure, an inverted downwardly flared channel is used as gas collector 70 and is placed immediately below and attached, for example by support welding, to the bottom of rod 76.

Figure 7:
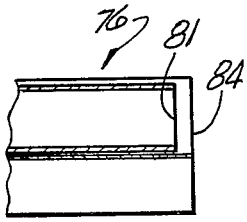
FIG. 7 is a vertical, longitudinal, cross-sectional view of portion 7 of the anode of FIG. 3 showing a tip of a conductor rod of the anode of FIG. 3.
Figure 8:
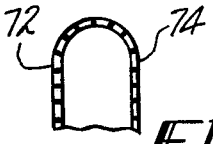
FIG. 8 is a vertical, transverse, cross-sectional view of the top edge of the anode of FIG. 3 taken along lines 8—8 of FIG. 3.
Figure 6:
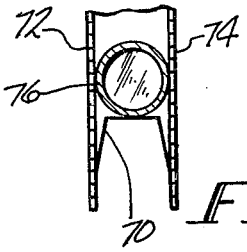
FIG. 6 is a transverse, vertical, cross-sectional view through the anode of FIG. 3 taken along line 6—6 of FIG. 3 showing a conductor rod and baffle.

Rods 76 are preferably copper rods with a titanium cladding of suitable thickness so as to prevent copper from dissolving into the anolyte 68. Similarly, gas collectors 70 are preferably titanium sheet so as to prevent them from dissolving into the anolyte 68. As best seen in FIG. 7, the outer tip 81 of each rod 76 is provided with an anolyte-resistant plug 84 to prevent dissolving of tip 81. This plug 84 can be attached to tip 81 by seal welding or other suitable attachment means.

Figure 5:
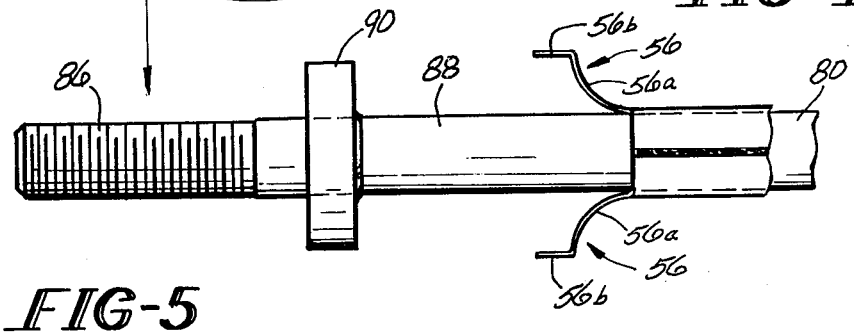
FIG. 5 is an enlarged top view of portion 5 of FIG. 4 showing the anode connectors.

Connector portion 78 is best seen by reference to FIG. 5 and comprises threaded section 86, an unthreaded section 88 and a flange 90. As noted above, threaded section 86 is designed to pass through an opening in backplate 16 and receive a nut 82 on the outer surface of backplate 16 so as to hold rod 76 in position. Unthreaded section 88 connects threaded section 86 with mesh attachment portion 80. Flange 90 is a titanium washer or other anolyte-resistant annular body attached to unthreaded section 88 at a position such that it abuts the inner surface of backplate 16 when nut 82 is tightened upon threaded section 86. Flange 90 can be attached to unthreaded section 88 by seal welding or other suitable connection means and is oriented perpendicular to threaded section 86. Threaded section 86 and unthreaded section 88 may be either aligned or unthreaded section 88 may slope downwardly relative to threaded section 86. The outer end of unthreaded section 88 is attached to attachment portion 80 by any conventional means and is preferably integral with portion 80. In fact, the preferred threaded section 86, unthreaded section 88 and attachment portion 80 are all integral parts of a single rod. At the junction of unthreaded section 88 and attachment portion 80, a spacer portion 56 is provided. Spacer portion 56 comprises an outwardly curved portion **56*a* and a flat portion 56*b*. Portion 56*a* generally is curved so as to conform to the outer end of a cathode finger (not shown) which could be interleaved between two anode fingers 54 while flat portion 56*b* is oriented parallel to surfaces 72 or 74 and is adapted to abut a similar flat portion 56*b* of an adjacent finger 54 so portions 56*a* form a generally semi-circular transition between adjacent anode fingers 54 at approximately the juncture of section 88 with portion 80. Spacer portion 56*a* also serves to help restrain and position membrane 55 (see FIG. 2**).

The design of disengaging space 66 is best seen by reference to FIG. 9 which is an enlarged view of region 9 of FIG. 2. As noted above, disengaging space 66 is the portion of gas escape space 62 between disengager 30 and backplate 16. Disengager 30 is a rectangular member of S-shaped cross-section, as noted above with reference to FIG. 2. The upper portion **30*a* of disengager 30, which lies above finger 54, is the portion which defines space 66. Disengager 30 also comprises two side portions and a bottom portion so that it resembles a picture frame which is much thicker at the top than either the side or bottom. Thus the vertical height of upper portion 30*a* is somewhat greater than the height of the bottom portion 30*b* of disengager 30. Upper portion 30*a* comprises an upper vertical flange 92, a horizontal center portion 94 and a vertical lower portion 96. Upper flange 92 is adapted to lie between backplate 16 and flange 36 of housing 13. It will be understood that the side and bottom portions of disengager 30 will have similar flanges adapted to lie between backplate 16 and flange 36. The inner surface of backplate 16, both surfaces of disengager 30 and the interior of housing 13 can be lined with a rubber lining 64 or other conventional anolyte-resistant lining. A gasket 98 is placed between backplate 16 and flange 92 and a gasket 100 placed between flange 92 and flange 36. With gaskets 98 and 100 in place, backplate 16 is clamped tightly against flange 36 so as to seal flange 92 and gaskets 98 and 100 therebetween. In this position, flange 92 lies parallel to and in close proximity to backplate 16 and lower portion 96 lies parallel to backplate 16 and is spaced therefrom by a selected distance determined by the width of center portion 94. The width of center portion 94 can be varied so as to achieve any width disengaging space desired. This is done by removing a given disengager 30 and replacing the removed disengager 30 with another disengager having either a wider or thinner center portion 94. It is expected that for any given cell structure a single size disengager 30 will suffice and that there will be little or no need to vary the thickness of portion 94. The level of anolyte 68 in cell 10 is maintained above the lower tip 102 of upper portion 38 and at a level between spent brine outlet 22 and chlorine outlet 24**, as noted above.

Mesh clamping base 60 is a rectangular frame which is placed between disengager 30 and anode finger 54. Preferably, base 60 is aligned with portion 96 of disengager 30 and spacer portion 56 of finger 54. Base 60 serves to support the membrane or diaphragm in cell designed having a "loose" diaphragm or membrane which is clamped by a perimeter clamp about all anode fingers 54 collectively, of the cell 10. Such clamps can be of any conventional design and are thus depicted in general fashion by clamp 104 and associated gasket 106. A membrane 55 or diaphragm would be placed between gasket 106 and lining 64 and clamped tightly by clamp 104. The attachment of threaded section 86 or rod 76 is seen in FIG. 9. Nut 82 is threaded onto threaded section 86 and pulls threaded section 86 downwardly until flange 90 rests against the lined inner surface of backplate 16 so as to firmly position finger 54 in a desired orientation.

Having now described the structure of the preferred gas separation assembly 52, the operation of assembly 52 will be self-evident, however, a brief description of such operation will nevertheless now be provided to facilitate understanding of the invention. The operation of assembly 52 is best seen by reference to FIGS. 2 and 9. Current is supplied to backplate 16 and in turn passes through rods 76 to surfaces 72 and 74 and from surfaces 72 and 74 through anolyte 68 to the cathode fingers and cathode of cell 10. A membrane or diaphragm is interposed between anode fingers 54 and the cathode fingers so as to minimize cation exchange between anolyte 68 and the catholyte 108. During passage of current from anode finger 54 through anolyte 68, a gas, such as chlorine, is generated. Gas bubbles therefore form within anolyte 68 and such gas bubbles tend to rise within anode finger 54. Gas collectors 70 serve to collect these rising bubbles and to encourage them to coalesce to form larger bubbles and change the direction of flow from upward to lateral, thus in part separating such bubbles from the surrounding anolyte liquid. The collected bubbles tend to flow along collectors 70 and into gas escape space 62. Such gas bubbles entering space 62 tend to rise rapidly into disengaging space 66 and due to their size tend to form much less foam than is conventionally found where the smaller bubbles are allowed to rise unrestricted through the anode fingers into some disengaging space thereabove. In this way, disengaging space 66 is only about 10 percent of the size of the minimum disengaging space heretofore thought to be required. For example, U.S. Pat. No. 3,855,091 says a CR above 0.10 is required whereas disengaging space 66 of cell 10 has a CR of less than 0.01. By this structure, the costly external disengagers such as that of U.S. Pat. No. 3,855,091 are made unnecessary and yet satisfactory gas disengagement is provided and foam formation is kept to a minimum. In fact, the area of disengaging space 66 can be less than a tenth of the maximum size of the chlorine riser or "perc pipe" of U.S. Pat. No. 3,855,091 which perc pipe is designed specifically to cause foam to flow into an external disengager. In cell 10, space 66 has been found to have little frothing and does not feed bubbles or foam into either outlet 22 or 24.

It will be understood that the structure and operations above described for the anode side of cell 10 could also be utilized for the cathode side of cell 10. Similarly, if a membrane enclosed cathode or diaphragm enclosed cathode were utilized, the gas collector and minimum disengaging space concept above described could be utilized to disengage hydrogen gas from the catholyte. In fact, the disengaging system of the invention could be utilized for anolyte disengagement alone, catholyte disengagement alone or both anolyte and catholyte disengagement. As described above, a horizontal rod could also be utilized with a trough-like, closed-ended horizontal gas collector having an opening adjacent the end of such a gas collector closest to backplate 16 so as to collect and coalesce small bubbles and release larger bubbles into space 62 so that such bubbles might be disengaged easily in space 66. It is thus seen that the invention is of sufficient scope to encompass a variety of equivalent structures having a gas collecting means within a gas-evolving electrode and a disengager having a CR less than 0.13 so as to achieve satisfactory disengaging within the cell without the need for costly external gas disengagers. While the invention has been described with specific reference to the separation of chlorine gas from anolyte in a chlor-alkali cell, the invention can be utilized in other electrochemical systems requiring gas separation at high current densities which currently require external disengagers. The dimensions and relative sizes of the anodes and the anolyte disengager can be varied widely to suit the particular cell size and geometry so long as the specific limitations of the invention are kept in mind. The invention could also be applied to filter press cells of either bipolar or monopolar configuration with advantageous results. The invention is illustrated for purposes of example by the following specific examples.

EXAMPLE 1

A membrane cell is constructed according to FIGS. 1 through 9 incorporating membrane enclosed anodes having sloped gas collectors (FIGS. 2 and 3) and an internal anolyte disengager (FIG. 9). This cell had anode surfaces of 44 inches in height and 36 inches in length and approximately 1 inch in thickness. The cell was operated for about 3 months with a perfluorosulfonic acid membrane at a current density of about 2 kiloamperes per square meter and a temperature of up to 90° C. At all times, the anolyte chlorine gas separation was satisfactory. The disengager surface area was calculated to be 131 square inches (0.93 square feet) at a cell load of 100 kiloamperes for a CR of 0.0093.

EXAMPLE 2

Another membrane cell of similar geometry to the cell of Example 1 was operated for several days with a disengaging surface factor (CR) of 0.0058 with satisfactory chlorine separation from the anolyte.

What is claimed is:

1. In the process of electrolyzing a brine in an electrolytic cell, having at least one anode, at a total cell current above 2500 amperes per square foot of internal cell horizontal area whereby a froth of chlorine and electrolyte would otherwise be generated, the improvement comprising:

(a) partially separating said froth into liquid and gas fractions within said anode; and (b) completing the substantial separation of said froth into liquid and gas fractions within said cell in a disengaging zone having a horizontal cross-section area of less than 0.13 square feet per kiloampere of total cell current.

2. The improvement of claim 1 wherein said step a) involves changing the momentum of said froth within a plurality of separation zones within said anodes.

3. A gas separation assembly for an electrolytic cell having a cell body having a side wall and containing a liquid electrolyte and a hollow gas evolving electrode in said liquid electrolyte and a total cell current density above 2500 amperes per square foot of horizontal, cross-sectional, internal cell area, which system comprises:

(a) a plurality of gas collector means within said gas evolving electrode extending across the interior space of said electrode and having portions defining an open end adjacent said side wall, for blocking upward flow of gas through said electrode and for vertically dividing said interior space into a plurality of separation zones and for collecting gas evolved by said electrode and for partially separating said evolved gas from said liquid electrolyte and for emitting said partially separated evolved gas through said open end; and (b) disengager means, located above said open end of said gas collector means and having less than 0.13 square feet of internal, horizontal, cross-sectional, disengaging area per kiloampere of total cell current, for receiving said partially separated, collected, evolved gas from said open end of said gas collector means and completing the separation of said gas.

4. The assembly of claim 3 wherein said disengager means is located entirely within said cell body.

5. The assembly of claim 3 or 4 wherein said disengager means has less than 0.10 square feet of horizontal, internal, cross-sectional area per kiloampere of total cell current.

6. The assembly of claim 5 wherein said disengager means has less than 0.01 square feet of horizontal, internal, cross-sectional area per kiloampere of total cell current.

7. The assembly of claim 3 or 4 wherein said disengager means has a horizontal cross-sectional area equal to less than 50 percent of said internal horizontal cross-sectional area of said cell.

8. The assembly of claim 7 wherein said disengager means has a horizontal cross-sectional area equal to less than 10 percent of said internal horizontal cross-sectional area of said cell.

9. The assembly of claim 3 wherein said gas collector means comprises downwardly opening inclined channel sloped upwardly toward said open end whereby gases movement toward said open end is promoted.

10. The assembly of claim 3 wherein said gas collector means comprises downwardly opening horizontal channel, and the end of said gas collecting means opposite said open end is closed so that gas is emitted from said open end.

11. The assembly of claim 9 or 10 wherein said downwardly opening channel includes:

(a) a center section having said open end and also having an opposite end away from said open end;

(b) a first end means closing said opposite end and having a bottom;

(c) a second end means partially closing said open end and having a bottom; and (d) said bottom of said second end means being located higher than said bottom of said first end so that gas bubbles tend to escape at said open end and flow upwardly therefrom into said disengager means.

* * * * *